US006772880B2

(12) United States Patent
Beverly

(10) Patent No.: US 6,772,880 B2
(45) Date of Patent: Aug. 10, 2004

(54) CLOTHES HANGER PACKAGE

(76) Inventor: Keith Beverly, P.O. Box 1116, Stinson Beach, CA (US) 94970

( * ) Notice: Subject to any disclaimer, the term of this patent is extended or adjusted under 35 U.S.C. 154(b) by 177 days.

(21) Appl. No.: 10/263,585

(22) Filed: Oct. 2, 2002

(65) Prior Publication Data

US 2004/0065566 A1 Apr. 8, 2004

(51) Int. Cl.[7] ..... B65D 85/00
(52) U.S. Cl. ..... 206/300
(58) Field of Search ..... 206/279, 300, 206/348, 443, 775, 784

(56) References Cited

U.S. PATENT DOCUMENTS 2,976,990 A * 3/1961 Nevai ..... 206/300
3,357,544 A * 12/1967 Gingher ..... 206/300

* cited by examiner

*Primary Examiner*—Jacob K. Ackun
(74) *Attorney, Agent, or Firm*—Louis Bovasso; Greenberg Traurig LLP

(57) ABSTRACT

A package comprised of a plurality of clothes hangers bound together by spaced frangible straps encircling their arms and an indicia bearing tag which has an aperture receiving therethrough hooks of at least one or more of the hangers encircling the same and extending downwardly below the main body portions of the hangers between the encircled hangers and an abutting hanger providing indicia thereon identifying the hangers.

5 Claims, 4 Drawing Sheets

CLOTHES HANGER PACKAGE

BACKGROUND OF THE INVENTION

The invention relates to clothes hangers; and, more particularly, for a package for binding together a plurality of hangers.

RELATED ART

Clothes hangers are well known in the art. Such hangers generally have a hook for hanging the same from a bar in a closet or the like. The hook is connected to the main body portion of the hanger which has spaced arms extending outwardly from opposite sides of the main body portion. Clothes, such as jackets or skirts, may be supported on the arms of the hanger.

Generally, such hangers are sold individually or packaged together in a plurality of hangers having an indicia bearing card encircling the main body portion of the hangers, the hooks thereof extending upwardly through an aperture in the card. Such cards cover the front and back of the body portions of the hangers so that the entire body portion is not visible. If the hanger is made of a desirable product, such as solid wood, the beauty of the product is not fully apparent. The hanger arms are generally not separately bound so that they may move apart and separate from the display card, especially during rough handling in a retail store or the like. This requires sale of the product at a distress price and possibly no identification to the customer of the manufacturer of the product.

There is thus a need for a package for a plurality of hangers that binds them together neat and tight yet displays information about the hangers in a pleasing manner.

SUMMARY OF THE INVENTION

It is an object of this invention to provide a package for a plurality of clothes hangers.

It is further object of this invention to provide such a package which binds together the spaced arms of the hangers while holding together the main body portions of the hangers in a manner displaying information about the hangers.

These and other objects are preferably accomplished by providing a package comprised of a plurality of clothes hangers bound together by spaced frangible straps encircling their arms. An indicia bearing tag which has an aperture receives therethrough hooks of one or more hangers encircling the same and extending downwardly below the main body portions of the hangers between the encircled hangers and an abutting hanger providing indicia thereon identifying the hangers.

DESCRIPTION OF THE PREFERRED EMBODIMENT

Figure 1:
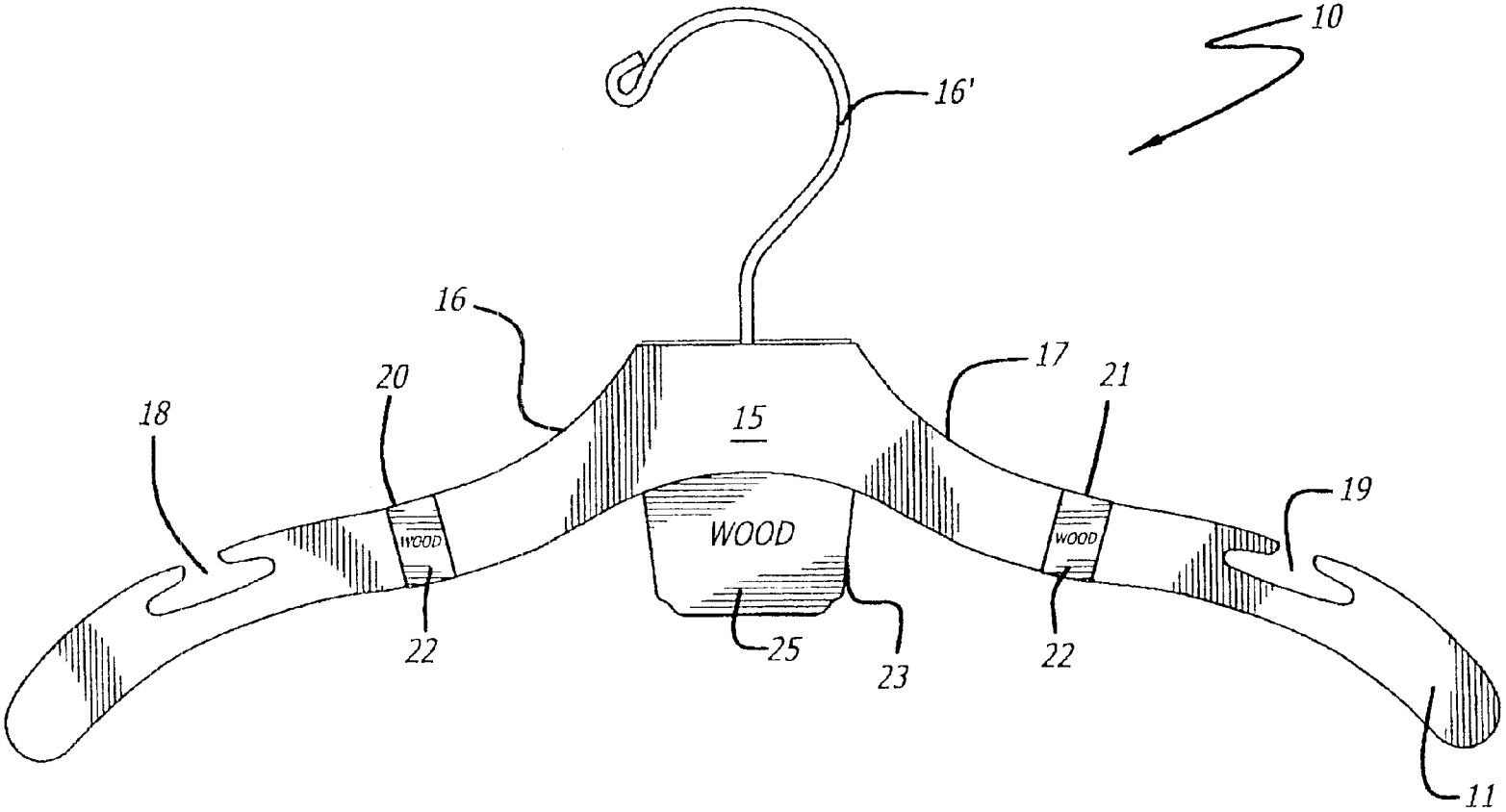
FIG. 1 is an elevational view of the hanger package in accordance with the teachings of the invention.
Figure 2:
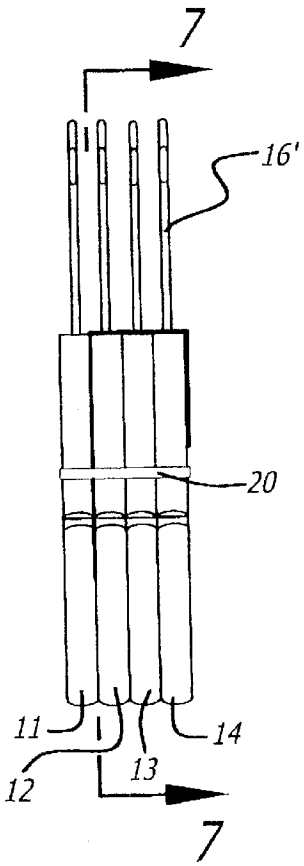
FIG. 2 is a side view of the hanger of FIG. 1.

Referring now to FIG. 1 of the drawing, a hanger package 10 is shown. As seen in FIG. 2, package 10 includes a plurality of hangers, such as four hangers 11 through 14. These hangers are identical and each comprises a main body portion 15 (FIG. 1) having a hook 16' connected thereto at generally the midpoint thereof for hooking the same on a pole in a closet or the like.

Each hanger includes a pair of spaced arms 16, 17 integral with and extending from opposite sides of main body portion 15. Arms 16, 17 may be angled downwardly as shown and may include notches, such as notches 18, 19, respectively, for hanging garment straps therein.

As particularly contemplated in the present invention, a pair of bands 20, 21 encircle all 4 arms of the hangers in a tight, close fitting relationship. For example, band 20 encircles arms 16 and band 21 encircles arms 17. These bands 20, 21 may be transparent and are easily cut or frangible. They may have indicia, such as indicia 22 thereon. Such indicia might relate to the quality of the hanger or to its composition. For example, the hangers may be made out of wood, the indicia might indicate the type of wood, e.g., maple, and the transparency of the bands 20, 21 allows the grain of the wood to be visible therethrough.

Referring again to FIG. 1, a securement placard 23 is provided which, as will be discussed, wraps around a plurality of the hangers. For example, placard 23 is shown in FIGS. 1 and 3 as wrapped around 3 of the hangers (hangers 12, 13 and 14) and abutting against the $4^{th}$ hanger 11.

Figure 4:
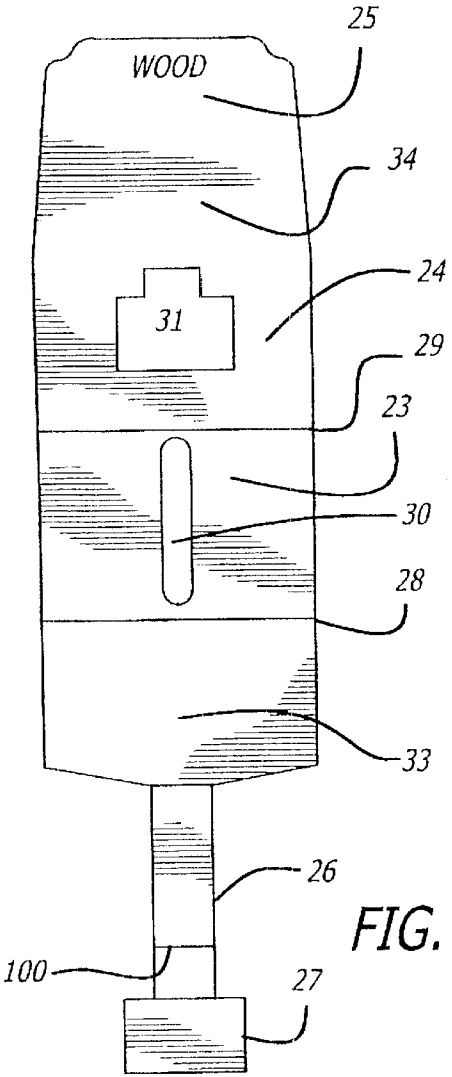
FIG. 4 is a plan view of a placard binding certain of the hangers of FIG. 1 removed therefrom for convenience of illustration.

Placard 23 is shown in plan view in FIG. 4 removed from the hangers 12 to 14. Placard 23 may be of a relatively stiff material, such as cardboard, and includes a generally rectangular main body portion 24 having indicia 25 at one end and an elongated tab 26 extending from the other end. Tab 26 terminates in a cross-piece 27. Main body portion 23 also includes a first fold line 28 spaced from tab 26 and a second fold line 29 spaced from fold line 28. An elongated oblong slot 30 extends between fold lines 28, 29 having a longitudinal axis generally normal to the longitudinal axes of fold lines 28, 29. The portion of main body portion 24 having indicia 25 thereon also has a generally T-shaped cut-out slot 31 with a fold line 100. The configuration of slot 31 is generally related to the configuration of cross-piece 27 and the configuration of that portion of tab 26 from fold line 100 to the terminal end of cross-piece 27 as will be discussed further hereinbelow.

Figure 3:
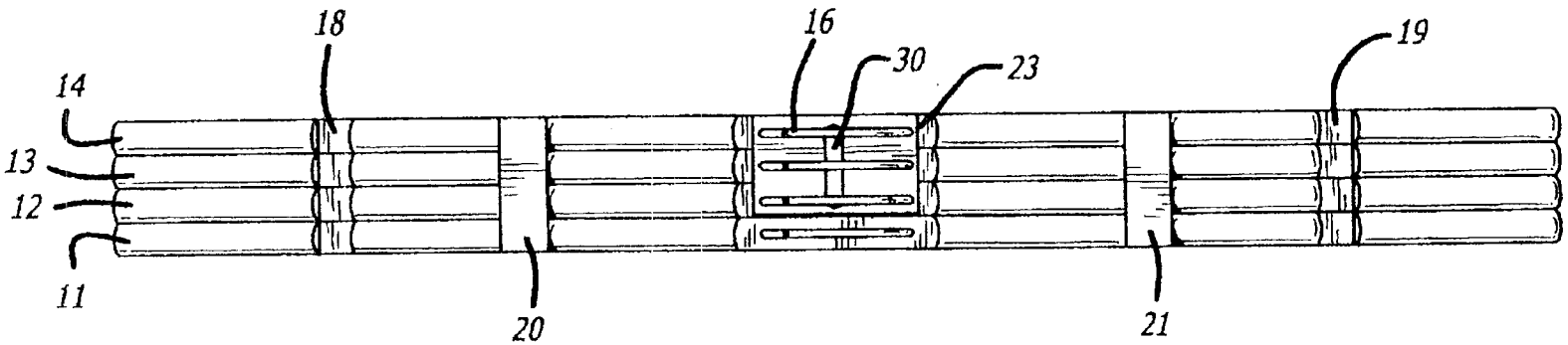
FIG. 3 is a top plan view of the hanger of FIG. 1
Figure 6:
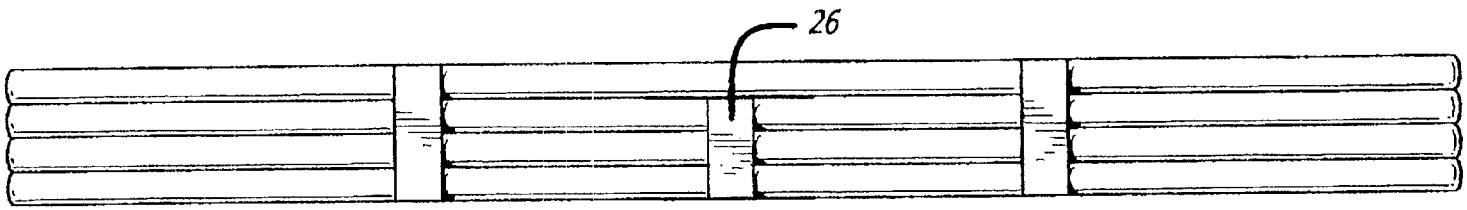
FIG. 6 is a bottom plan view of the hanger of FIG. 1.
Figure 5:
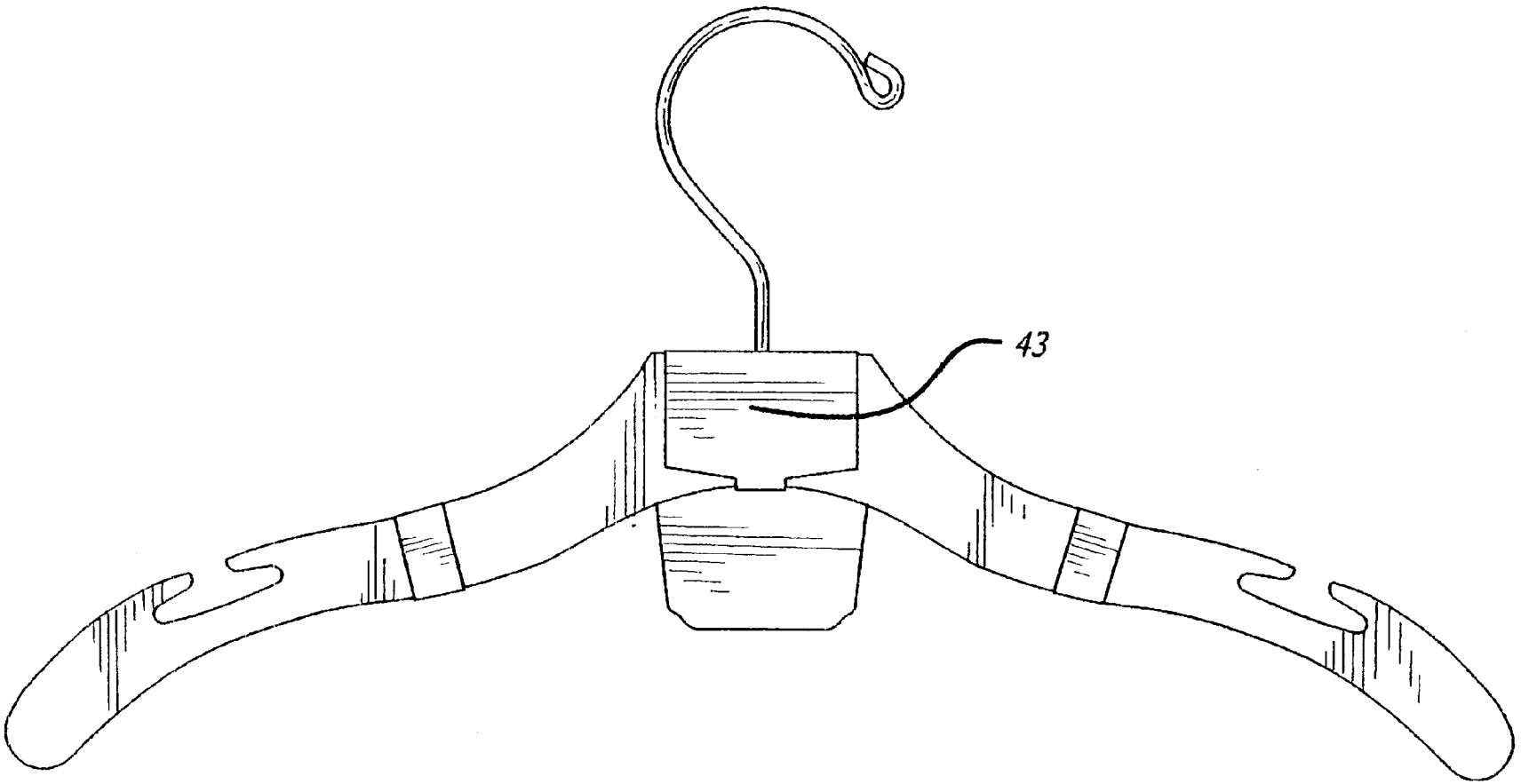
FIG. 5 is a rear view of the hanger of FIG. 1.

In operation, placard 23 is folded along fold lines 28, 29 and placed over the tops of the main body portions 15 of hangers 12 to 14 as shown in FIG. 3 with the hooks 16' thereof entering and exiting out of slot 30. The portion 33 (FIG. 4) of main body portion 24 having tab 26 thereon extends down from hanger 14 (see FIG. 5) with tab 26 (FIG. 6) extending across the bottom of hangers 12, 13 and 14. Tab 26 is folded at fold line 100, extends upwardly between the hangers 11 and 12 with cross-piece 27 fitting into slot 31 as seen in FIG. 7.

Figure 7:
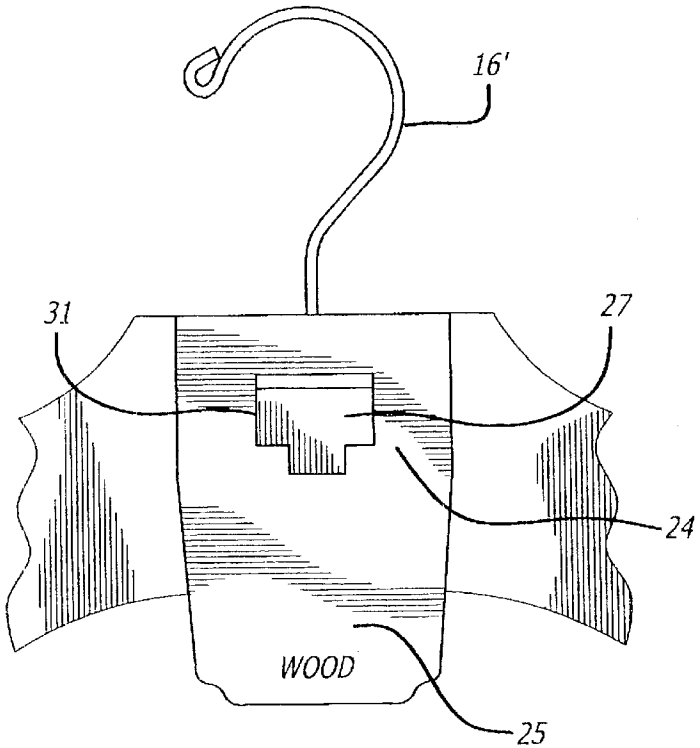
FIG. 7 is a partial view taken along lines 7—7 of FIG. 2 illustrating how the placard folds about the hangers of FIG. 1.

The friction of one hanger against the other, such as hanger 11 against hanger 12, holds the portion 27 of tab 26 in place which locks into slot 31 (see FIG. 7). As seen in FIG. 1, this arrangement provides for the portion 34 having indicia 25 thereon is visible to the customer. The hangers 11 to 14 are held together in a tidy neat package, do not separate under rough handling on a shelf or the like and can be prominently displayed on a store shelf with the material of the hangers, such as the grain of the wood, visible through bands 20, 21.

Although a particular embodiment of the invention is disclosed, variations thereof may occur to the artisan and the scope of the invention should only be limited by the scope of the appended claims.

I claim:

1. A hanger package comprised of:

a plurality of hangers abutting against each other, each hanger having a central main body portion with an upper surface and a lower surface and a pair of spaced integral arms extending outwardly from opposite sides of said main body portion, and a hook fixed to the main body portion extending upwardly therefrom for hooking said hanger onto a closet bar or the like;

a pair of frangible bands encircling each of the abutting arms of all of said hangers in a tight, close fitting relationship; and a placard encircling at least one or more of said abutting hangers, said placard having a first portion with an oblong slot therein, said hooks of said hangers encircled by said placard extending upwardly through said slot, said placard having a second portion hinged to said first portion extending downwardly from said first portion between one of said hangers encircled by said placard and another of said hangers not encircled by said placard and abutting thereagainst, said second portion extending below the lower surface of the main body portions of said hangers, said placard having a third portion spaced from said second portion hinged to said first portion and extending downwardly from said first portion to the lower surface of one of said hangers encircled by said placard and remote from the hanger from which said second portion extends downwardly with respect thereto, said third portion having a tab extending across the lower surface of said hangers encircled by said placard and upwardly forming an end portion disposed between said second portion and said hanger from which said second portion extends downwardly with respect thereto, the engagement of said hanger not encircled by said placard and said hanger encircled by said placard abutting thereagainst trapping said end portion of said tab therebetween functionally holding the end portion of said tab in place.

2. The package of claim 1 wherein said bands are of transparent material.

3. The package of claim 2 wherein said bands have indicia thereon.

4. The package of claim 1 wherein the main body portion and arms of said hangers are of wood.

5. The package of claim 1 wherein the second portion of said placard has indicia thereon below the lower surfaces of said hangers.

* * * * *